US008789541B1

(12) United States Patent
Evans

(10) Patent No.: US 8,789,541 B1
(45) Date of Patent: Jul. 29, 2014

(54) HOLDING SYSTEM AND ANTI-LEAK SYSTEM FOR NAIL POLISH

(71) Applicant: Lillie Ann Evans, Phoenix, IL (US)

(72) Inventor: Lillie Ann Evans, Phoenix, IL (US)

( * ) Notice: Subject to any disclaimer, the term of this patent is extended or adjusted under 35 U.S.C. 154(b) by 0 days.

(21) Appl. No.: 13/705,581

(22) Filed: Dec. 5, 2012

(51) Int. Cl.

| | |
|---|---|
| ***A45D 29/20*** | (2006.01) |
| ***B65D 45/24*** | (2006.01) |
| ***B65D 41/04*** | (2006.01) |
| *B65D 45/32* | (2006.01) |

(52) U.S. Cl.
CPC ..... *A45D 29/20* (2013.01); *B65D 45/24* (2013.01); *B65D 45/32* (2013.01); *B65D 41/0428* (2013.01)
USPC ..... 132/294; 132/73; 220/319; 215/394; 215/293; 215/275; 24/270

(58) Field of Classification Search
USPC ..... 132/73, 294, 315; 206/523, 581; 24/270, 303; 285/420, 364, 365, 366, 285/367; 220/319, 320, 321; 215/392, 394, 215/293, 275, 274
See application file for complete search history.

(56) References Cited

U.S. PATENT DOCUMENTS

| | | | | |
|---|---|---|---|---|
| 738,626 | A * | 9/1903 | Newell | 132/315 |
| 1,683,176 | A * | 9/1928 | Faulhaber | 215/392 |
| 1,689,085 | A * | 10/1928 | Russell et al. | 383/80 |
| 1,790,962 | A * | 2/1931 | Westing | 132/315 |
| 2,049,378 | A | 7/1936 | Holl | |
| 2,209,781 | A | 7/1940 | Lewis | |
| 2,219,597 | A | 10/1940 | Lutz | |
| 2,385,114 | A * | 9/1945 | Steckler | 215/274 |
| 3,520,563 | A * | 7/1970 | Decker, Jr. | 285/87 |
| 4,437,583 | A * | 3/1984 | O'Connor | 222/108 |
| 5,941,255 | A | 8/1999 | Chen | |
| 6,109,442 | A | 8/2000 | Roegner | |
| D457,687 | S | 5/2002 | Millar | |
| 7,185,452 | B2 * | 3/2007 | Brown | 40/310 |
| 7,240,930 | B2 * | 7/2007 | Stravitz | 285/419 |
| 2004/0045568 | A1 * | 3/2004 | Abbott et al. | 132/73 |
| 2005/0184523 | A1 * | 8/2005 | Stravitz | 285/419 |
| 2008/0185360 | A1 * | 8/2008 | Zak et al. | 215/392 |

* cited by examiner

*Primary Examiner* — Robyn Doan
*Assistant Examiner* — Tatiana Nobrega

(57) ABSTRACT

An anti-leak system for preventing nail polish from leaking from a nail polish bottle featuring a collar that wraps around the shoulder area, the thread area and the cap of the nail polish bottle. Foam lines the inner surface of the collar. The foam fills any gaps that may occur between the thread area and the cap, for example if the cap is not completely closed. The collar can be compressed around the nail polish bottle and secured vie a locking mechanism.

3 Claims, 7 Drawing Sheets

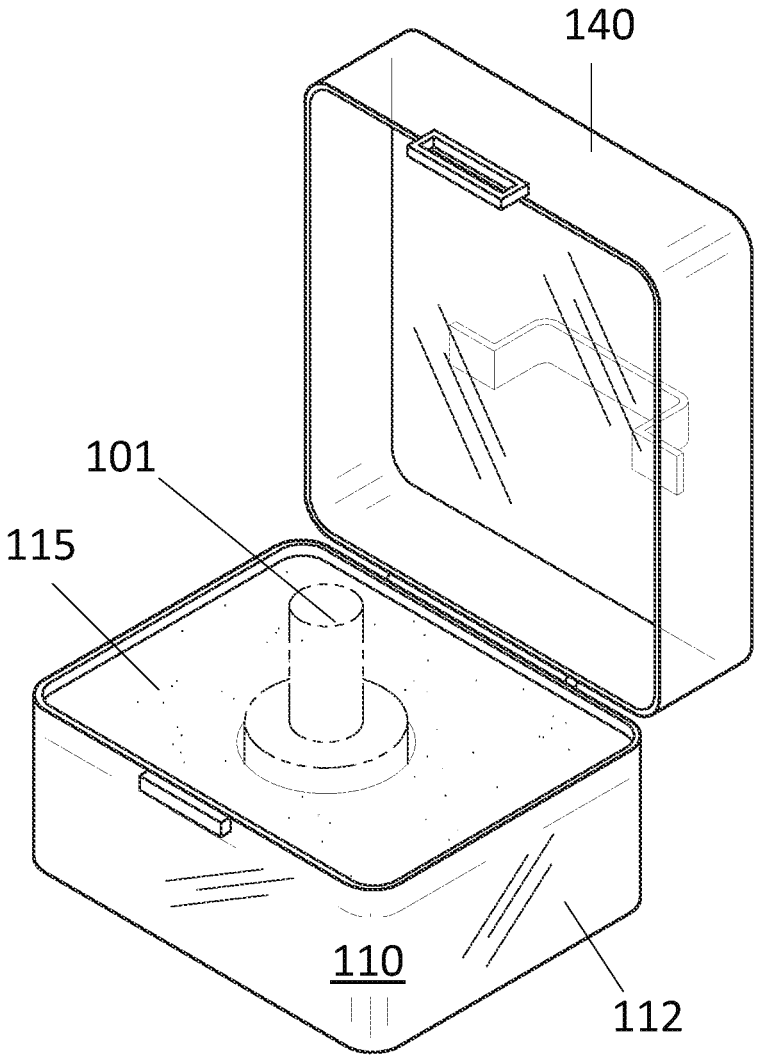
FIG. 5
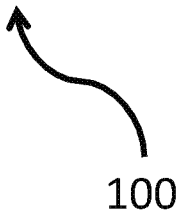

Isometric View -In Use

Cross Sectional View

Top View

HOLDING SYSTEM AND ANTI-LEAK SYSTEM FOR NAIL POLISH

BACKGROUND OF THE INVENTION

Nail polish bottles can leak, particularly if the cap isn't closed properly. The present invention features a holding system for holding a bottle of nail polish and an anti-leak system for preventing the bottle of nail polish from leaking, for example if the cap is not completely closed.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE DRAWINGS

FIG. 5 is a perspective view of an alternative embodiment of the holding system of the present invention, wherein the lid is in the open position.

DESCRIPTION OF PREFERRED EMBODIMENTS

Figure 1:
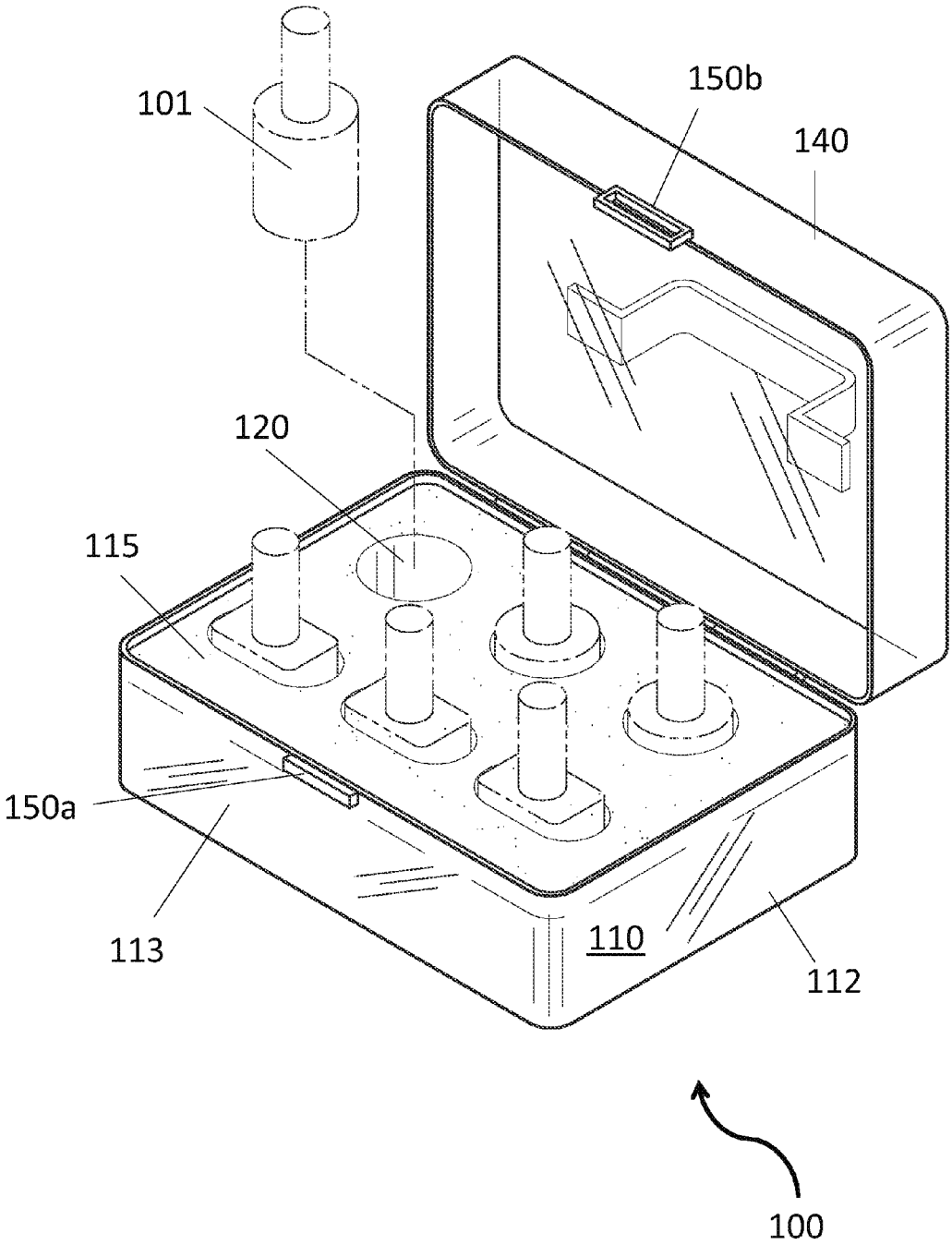
FIG. 1 is a perspective view of the holding system of the present invention, wherein the lid is in the open position.
Figure 2:
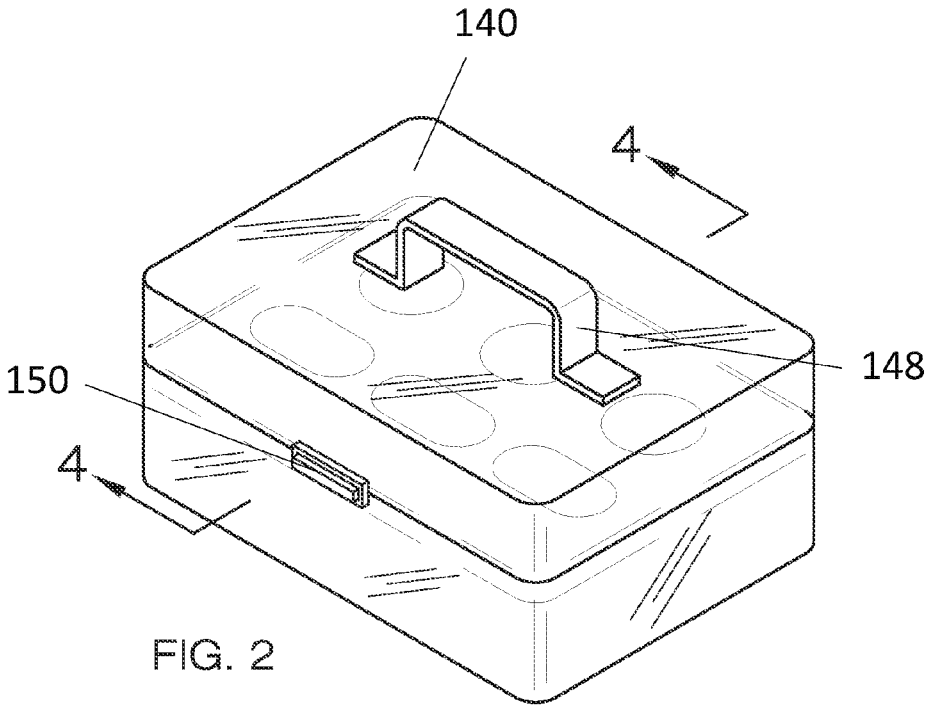
FIG. 2 is a perspective view of the holding system of the present invention, wherein the lid is in the closed position.
Figure 3:
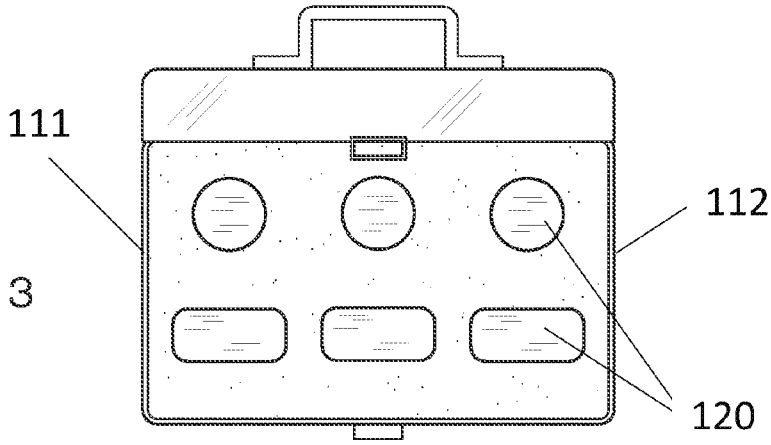
FIG. 3 is a top view of the holding system of the present invention, wherein the lid is in the open position.

Referring now to FIG. 1-8, the present invention features a holding system (100) and an anti-leak system (600) for nail polish bottles (101).

As shown in FIG. 1-5, the holding system (100) is adapted to hold one or more nail polish bottles (101). The holding system (100) comprises a base (110) having a top surface (115) wherein at least one cavity (120) is disposed in the top surface (115) adapted to hold a nail polish bottle (101). The base (110), e.g., as shown in FIG. 1-5, may have a front surface (113), a back surface (114), a first side (111), a second side (112), and a bottom surface (116).

The holding system (100) further comprises a lid (140) attached (e.g., pivotally attached) to the base (110). The lid (140) can move, e.g., pivot, between at least an open position and a closed position respectively allowing and preventing access to the top surface (115) and cavities (120) of the base (110). In some embodiments, a handle (148) is disposed on the lid (140), e.g., the top surface of the lid (140), for aiding in the movement of the lid (140) between the open position and closed position.

In some embodiments, the lid (140) functions to press down on the cap (105) of the nail polish bottle (101). In some embodiments, the pressure on the cap (105) can help prevent nail polish from leaking out of the nail polish bottle (101), e.g., if the cap (105) is not completely closed.

In some embodiments, a gasket (or other liquid-tight sealing mechanism) is disposed along the surface of the base (110) that contacts the lid (140) and/or along the surface of the lid (140) that contacts the base (110). The gasket (or liquid-tight sealing mechanism) can help to prevent nail polish from leaking out of the holding system (100) of a leak occurs inside the system (100).

In some embodiments, the holding system (100) further comprises a securing means (150) for securing the lid (140) in the closed position. The securing means (150) may include but is not limited to a snap mechanism, a magnet mechanism, a latch mechanism, a clasp mechanism, the like, or a combination thereof. In some embodiments, the securing means (150) comprises a first half securing means (150*a*) disposed on the base (110) and a second half securing means (150*b*) disposed on the lid (140) wherein when the lid (140) is in the closed position the first half securing means (150*a*) and second half securing means (150*b*) engage each other to temporarily secure the lid (140) in the closed position.

As shown in FIG. 1-5, the cavities (120) in the base (110) may be constructed in a variety of shapes and sizes. For example, in some embodiments, a cavity (120) is circular, oval, rectangular, and/or the like (as viewed from above the top surface (115) of the base (110)). The present invention is not limited to the aforementioned shapes.

Figure 4:
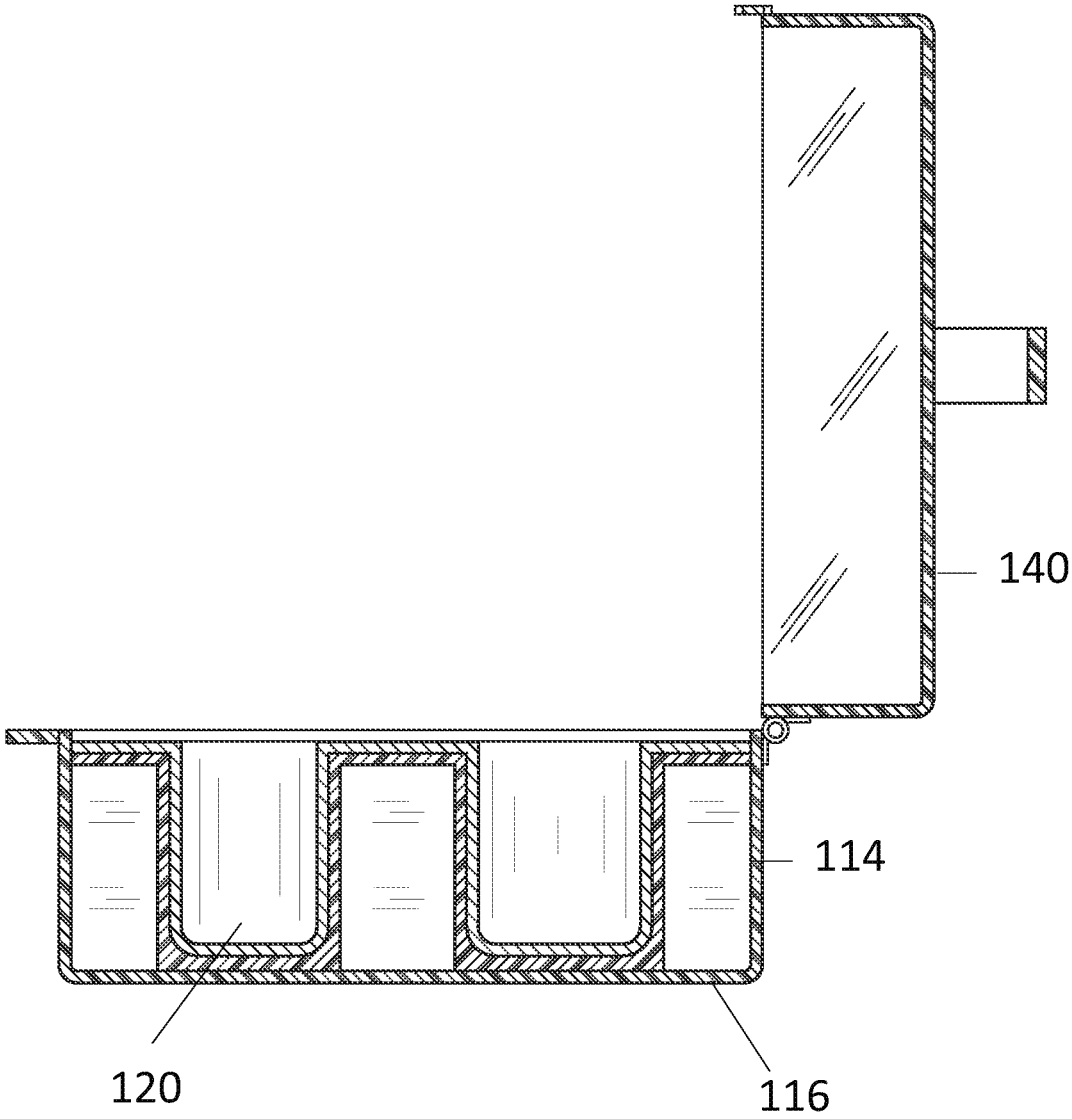
FIG. 4 is a side cross sectional view of the holding system of the present invention, wherein the lid is in the open position.

As shown in FIG. 4, in some embodiments, the base (110) is filled with a material, e.g., a foam material. The base (110) is not limited to foam and any other appropriate material may be used. The cavities (120) extend from the top surface (115) of the base (110) to at or near the bottom surface (116).

Figure 6:
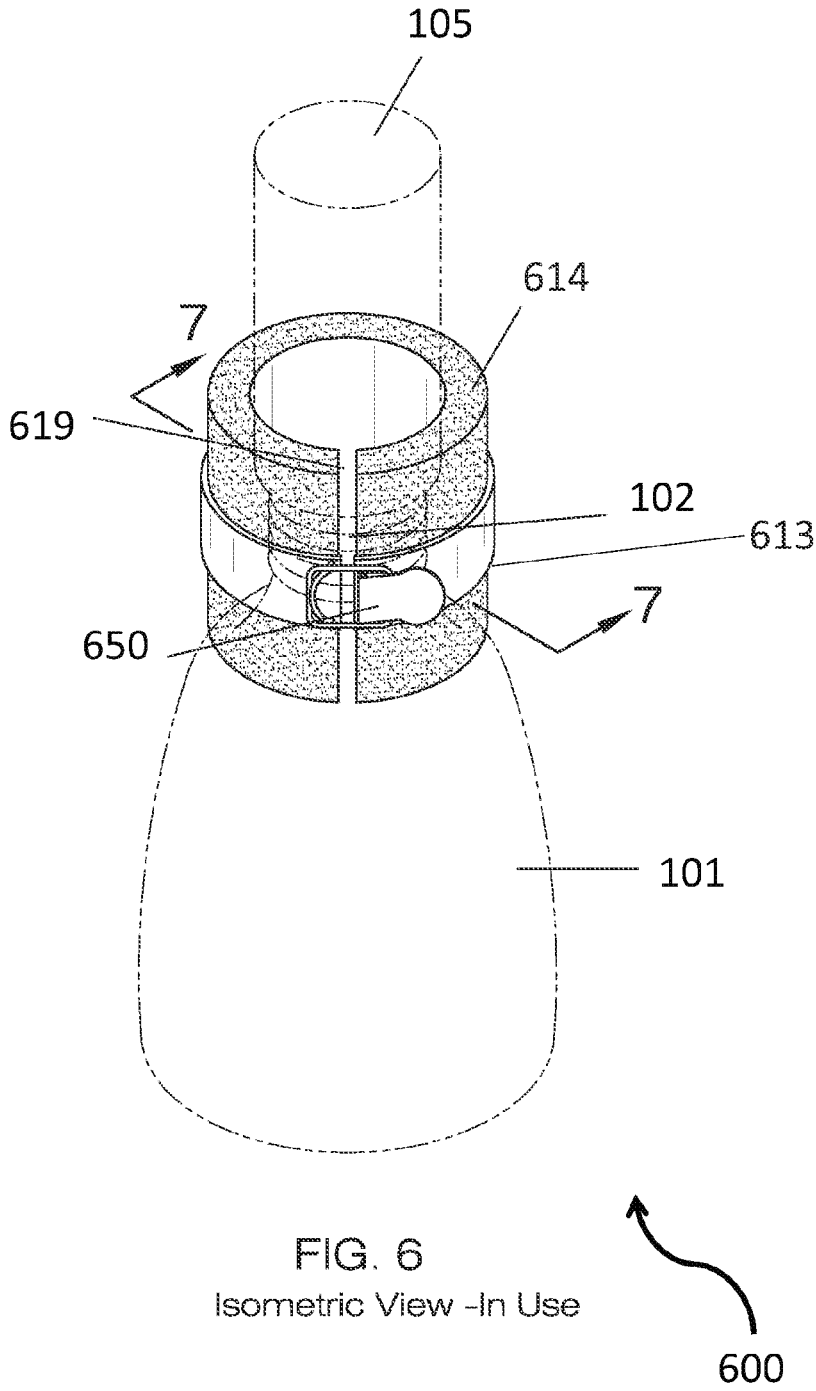
FIG. 6 is an in-use perspective view of the anti-leak system of the present invention.
Figure 7:
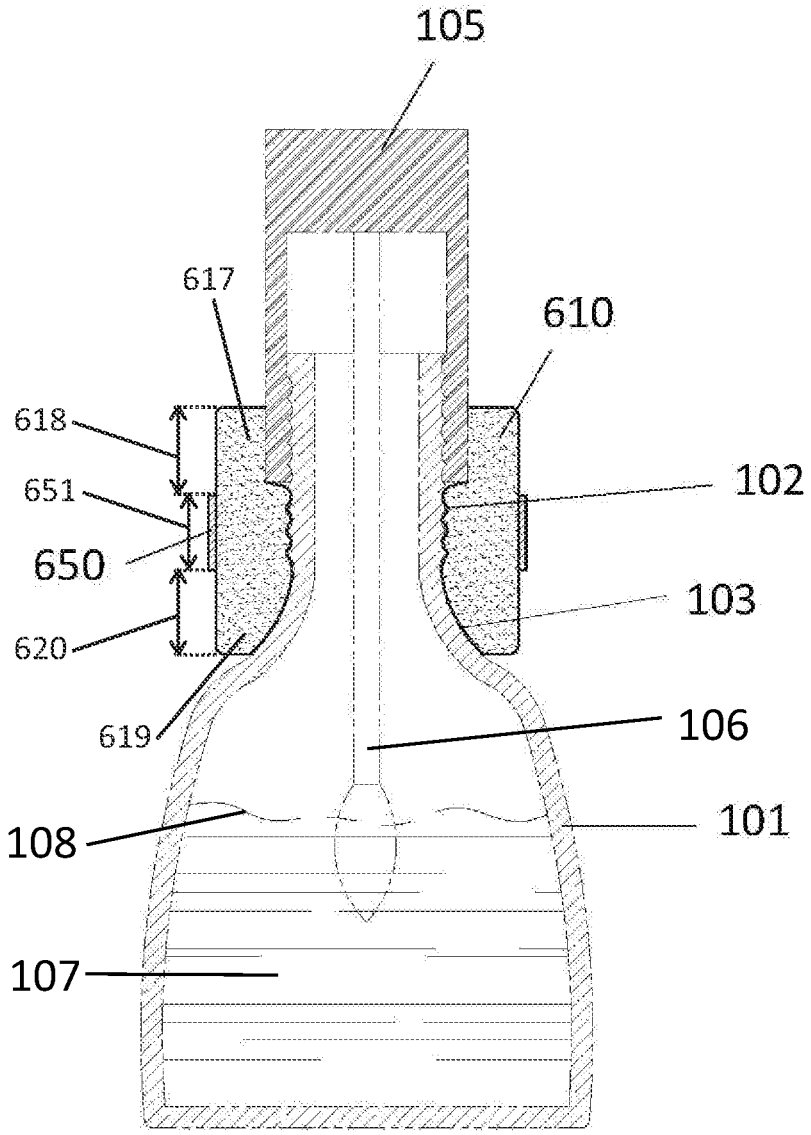
FIG. 7 is a side cross sectional view of the anti-leak system of the present invention.
Figure 8:
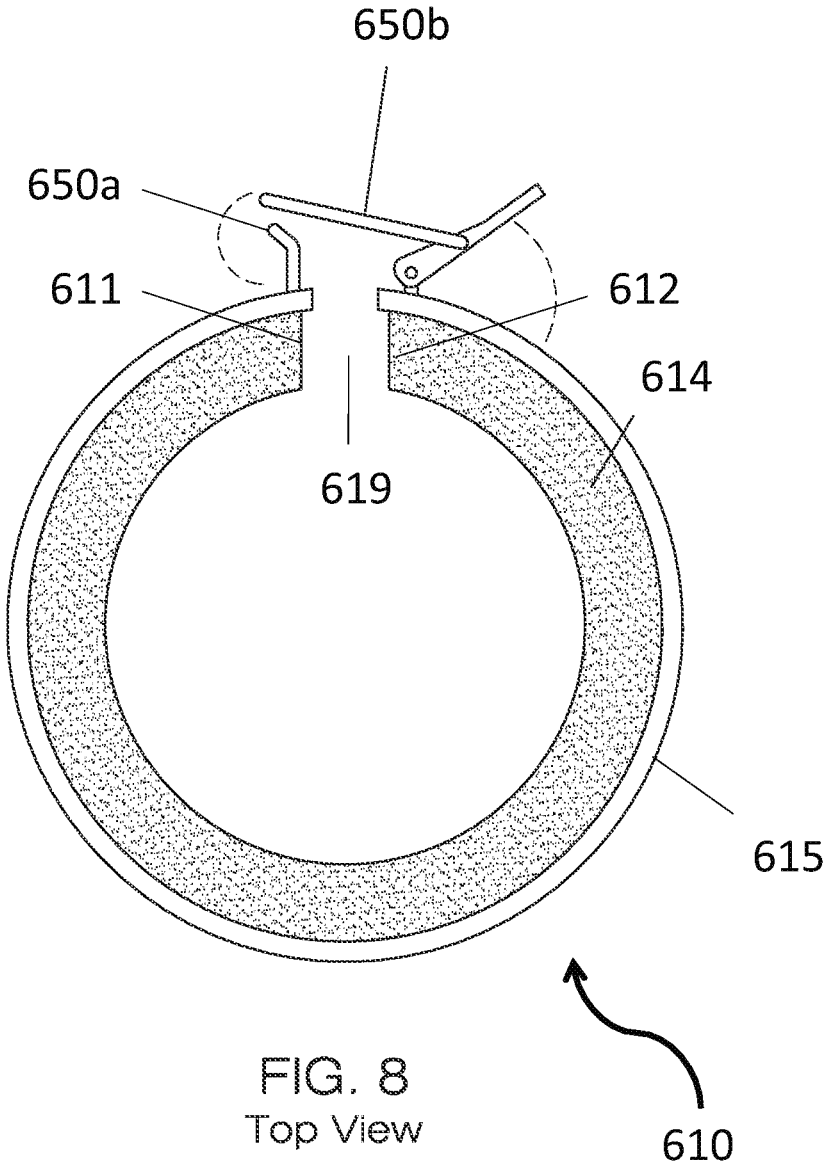
FIG. 8 is a top view of the of the anti-leak system of the present invention.

As shown in FIG. 6-8, the anti-leak system (600) helps to prevent a nail polish bottle from leaking (e.g., via the cap area), for example if the cap isn't completely closed (the cap is shown as not being fully closed in FIG. 7).

The anti-leak system (600) comprises a collar (610) adapted to wrap around a portion of the nail polish bottle (101), e.g., the shoulder area (103), the threads (102), and the cap (105) or the nail polish bottle (101). The collar (610) is ring shaped as shown in FIG. 8. The collar (610) has a first end (611), a second end (612) opposite the first end (611), an outer surface (613), and an inner surface (614). The collar (610) may not necessarily be a complete ring, for example the first end (611) and second end (612) may be separated by a gap (619).

In some embodiments, the inner surface (614) comprises a foam material or other compressible material. The inner surface (614) of the collar (610) wraps around and cushions the shoulder area (103), threads (102) (if exposed), and at least the bottom portion of the cap (105) of the nail polish bottle (101). The foam or compressible material helps to fill in any exposed area of the threads (102) and cap (105) so as to prevent nail polish from leaking from the bottle (101).

In some embodiments, (e.g., as shown in FIG. 6), the inner surface (614) of the collar (610) extends upwardly and/or downwardly past the outer surface (613) of the collar (610).

The collar (610) can move between at least a compressed position and a relaxed position. In the compressed position, the collar (610) is squeezed, e.g., such that the first end (611) and second end (612) move towards each other and meet or come in contact with each other. In the compressed position, the collar (610) helps to cushions the shoulder area (103), threads (102) (if exposed), and at least the bottom portion of the cap (105) of the nail polish bottle (101) and optionally fill in any exposed area of the threads (102) and cap (105) so as to prevent nail polish from leaking from the bottle (101). In the relaxed position, the first end (611) and second end (612) of the collar (610) are separated by the gap (619), and the collar (610) can be attached to or removed from the nail polish bottle (101).

The anti-leak system (600) further comprises a locking mechanism (650) for securing the collar (610) in the compressed position.

The locking mechanism (650) may include but is not limited to a snap mechanism, a magnet mechanism, a latch mechanism, a clasp mechanism, the like, or a combination thereof. In some embodiments, the locking mechanism (650) comprises a first half locking mechanism (650*a*) disposed at the first end (611) of the collar (610) and a second half locking mechanism (650*b*) disposed at the second end (6120) of the collar (610), wherein when the collar (610) is in the compressed position the first half locking mechanism (650*a*) and second half locking mechanism (650*b*) engage each other to temporarily secure the collar (610) in the compressed position.

The present invention also features a kit comprising a holding system (100) and an anti-leak system (600).

As used herein, the term "about" refers to plus or minus 10% of the referenced number. For example, an embodiment wherein the base is about 10 inches in length includes a base that is between 9 and 11 inches in length.

The disclosures of the following U.S. Patents are incorporated in their entirety by reference herein: U.S. Pat. No. 2,219,597; U.S. Pat. No. 2,209,781; U.S. Pat. No. 2,049,378; U.S. Pat. No. 6,109,442; U.S. Pat. No. 5,941,255.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. An anti-leak system (600) for preventing nail polish from leaking from a nail polish bottle (101), said anti-leak system (600) comprising:

(a) the nail polish bottle (101) comprising a thread area (102), a shoulder area (103), a cap (105) having a nail polish applicator (106), a reservoir (107), and a nail polish (108), wherein the thread area (102) is disposed above the shoulder area (103), wherein the cap matingly threads onto the thread area (102), wherein the nail polish (108) is stored inside the reservoir (107);

(b) a collar (610) for wrapping around at least the shoulder area (103), the thread area (102), and a bottom portion of the cap (105) of the nail polish bottle (101), the collar (610) is ring-shaped and has a first end (611), a second end (612) opposite the first end (611), an outer surface (613), and an inner surface (614), the first end (611) and second end (612) are separated by a gap (619), the inner surface (614) is constructed from a material comprising foam, the collar (610) can move between at least a compressed position and a relaxed position, wherein in the compressed position the collar (610) is squeezed such that the first end (611) and second end (612) move towards each other and come in contact with each other, when the collar (610) is in the compressed position around a nail polish bottle (101), the inner surface (614) of the collar (610) wraps around and cushions the shoulder area (103), the thread area (102), and the bottom portion of the cap (105) of the nail polish bottle (101), the foam helps fill an exposed area of the threads (102) and cap (105) so as to prevent nail polish from leaking from the nail polish bottle (101), wherein in the relaxed position the first end (611) and second end (612) of the collar (610) are separated by the gap (619) and the collar (610) can be attached to or removed from the nail polish bottle (101); and (c) a locking mechanism (650) for securing the collar (610) in the compressed position, the locking mechanism (650) comprises a first half locking mechanism (650*a*) disposed at the first end (611) of the collar (610) and a second half locking mechanism (650*b*) disposed at the second end (6120) of the collar (610), wherein when the collar (610) is in the compressed position the first half locking mechanism (650*a*) and second half locking mechanism (650*b*) engage each other to temporarily secure the collar (610) in the compressed position;

wherein the inner surface (614) of the collar (610) extends upwardly and downwardly past the outer surface (613) of the collar (610), wherein a top section (617) of the collar (610) has a first length (618) and a bottom section (619) of the collar (610) has a second length (620), wherein the locking mechanism (650) has a third length (651), wherein the first length (618) and the second length (620) are greater than the third length (651); and wherein the locking mechanism (650) comprises a snap mechanism, a magnet mechanism, a latch mechanism, a clasp mechanism, or a combination thereof.

2. A kit comprising:

(a) a nail polish bottle (101) comprising a thread area (102), a shoulder area (103), a cap (105) having a nail polish applicator (106), a reservoir (107), and a nail polish (108), wherein the thread area (102) is disposed above the shoulder area (103), wherein the cap matingly threads onto the thread area (102), wherein the nail polish (108) is stored inside the reservoir (107);

(b) a holding system (100) for holding the nail polish bottle (101) comprising: (i) a base (110) having a top surface (115), wherein at least one cavity (120) is disposed in the top surface (115) adapted to hold the nail polish bottle (101); (ii) a lid (140) pivotally attached to the base (110), the lid (140) can pivot between at least an open position and a closed position respectively allowing and preventing access to the top surface (115) and cavity (120) of the base (110); and (iii) a securing means (150) for securing the lid (140) in the closed position, the securing means (150) comprises a first half securing means (150*a*) disposed on the base (110) and a second half securing means (150*b*) disposed on the lid (140) wherein when the lid (140) is in the closed position the first half securing means (150*a*) and second half securing means (150*b*) engage each other to temporarily secure the lid (140) in the closed position; and (c) an anti-leak system (600) for preventing nail polish from leaking from a nail polish bottle (101), said anti-leak system (600) comprising (i) a collar (610) for wrapping around at least the shoulder area (103), the thread area (102), and a bottom portion of the cap (105) of the nail polish bottle (101), the collar (610) is ring-shaped and has a first end (611), a second end (612) opposite the first end (611), an outer surface (613), and an inner surface (614), the first end (611) and second end (612) are separated by a gap (619), the inner surface (614) is constructed from a material comprising foam, the collar (610) can move between at least a compressed position and a relaxed position, wherein in the compressed position the collar (610) is squeezed such that the first end (611) and second end (612) move towards each other and come in contact with each other, when the collar (610) is in the compressed position around a nail polish bottle (101), the inner surface (614) of the collar (610) wraps around and cushions the shoulder area (103), the thread area (102), and the bottom portion of the cap (105) of the nail polish bottle (101), the foam helps fill an exposed area of the threads (102) and cap (105) so as to prevent nail polish from leaking from the nail polish bottle (101), wherein in the relaxed position the first end (611) and second end (612) of the collar (610) are separated by the gap (619) and the collar (610) can be attached to or removed from the nail polish bottle (101); and (ii) a locking mechanism (650) for securing the collar (610) in the compressed position, the locking mechanism (650) comprises a first half locking mechanism (650*a*) disposed at the first end (611) of the collar (610) and a second half locking mechanism (650*b*) disposed at the second end (6120) of the collar (610), wherein when the collar (610) is in the compressed position the first half locking mechanism (650*a*) and second half locking mechanism (650*b*) engage each other to temporarily secure the collar (610) in the compressed position;

wherein a handle (148) is disposed on the lid (140) for aiding in movement of the lid (140) between the open position and closed position; wherein the cavity (120) is circular, oval, or rectangular in shape, wherein the securing means (150) consists of a snap mechanism, a magnet mechanism, a latch mechanism, a clasp mechanism, or a combination thereof;

wherein the inner surface (614) of the collar (610) extends upwardly and downwardly past the outer surface (613) of the collar (610), wherein a top section (617) of the collar (610) has a first length (618) and a bottom section (619) of the collar (610) has a second length (620), wherein the locking mechanism (650) has a third length (651); wherein the first length (618) and the second length (620) are greater than the third length (651); and wherein the locking mechanism (650) comprises a snap mechanism, a magnet mechanism, a latch mechanism, a clasp mechanism, or a combination thereof.

3. An anti-leak system (600) for preventing nail polish from leaking from a nail polish bottle (101), said anti-leak system (600) consisting of:

(a) the nail polish bottle (101) consisting of a thread area (102), a shoulder area (103), a cap (105) having a nail polish applicator (106), a reservoir (107), and a nail polish (108), wherein the thread area (102) is disposed above the shoulder area (103), wherein the cap matingly threads onto the thread area (102), wherein the nail polish (108) is stored inside the reservoir (107);

(b) a collar (610) for wrapping around at least a shoulder area (103), a thread area (102), and a bottom portion of a cap (105) of a nail polish bottle (101), the collar (610) is ring-shaped and has a first end (611), a second end (612) opposite the first end (611), an outer surface (613), and an inner surface (614), the first end (611) and second end (612) are separated by a gap (619), the inner surface (614) is constructed from a material consisting of foam, the collar (610) can move between at least a compressed position and a relaxed position, wherein in the compressed position the collar (610) is squeezed such that the first end (611) and second end (612) move towards each other and come in contact with each other, when the collar (610) is in the compressed position around a nail polish bottle (101), the inner surface (614) of the collar (610) wraps around and cushions the shoulder area (103), the thread area (102), and the bottom portion of the cap (105) of the nail polish bottle (101), the foam helps fill an exposed area of the threads (102) and cap (105) so as to prevent nail polish from leaking from the nail polish bottle (101), wherein in the relaxed position the first end (611) and second end (612) of the collar (610) are separated by the gap (619) and the collar (610) can be attached to or removed from the nail polish bottle (101); and (c) a locking mechanism (650) for securing the collar (610) in the compressed position, the locking mechanism (650) consists of a first half locking mechanism (650*a*) disposed at the first end (611) of the collar (610) and a second half locking mechanism (650*b*) disposed at the second end (6120) of the collar (610), wherein when the collar (610) is in the compressed position the first half locking mechanism (650*a*) and second half locking mechanism (650*b*) engage each other to temporarily secure the collar (610) in the compressed position;

wherein the inner surface (614) of the collar (610) extends upwardly and downwardly past the outer surface (613) of the collar (610), wherein a top section (617) of the collar (610) has a first length (618) and a bottom section (619) of the collar (610) has a second length (620), wherein the locking mechanism (650) has a third length (651), wherein the first length (618) and the second length (620) are greater than the third length (651); and wherein the locking mechanism (650) consists of a snap mechanism, a magnet mechanism, a latch mechanism, a clasp mechanism, or a combination thereof.

* * * * *